US006104022A

United States Patent [19]

Young et al.

[11] Patent Number: 6,104,022

[45] Date of Patent: Aug. 15, 2000

[54] LINEAR APERTURE PSEUDOSPARK SWITCH

[75] Inventors: Christopher M. Young, Jacksonville, Fla.; William R. Cravey, Albuquerque, N. Mex.

[73] Assignee: TETRA Corporation, Albuquerque, N. Mex.

[21] Appl. No.: 08/890,485

[22] Filed: Jul. 9, 1997

Related U.S. Application Data

[60] Provisional application No. 60/021,411, Jul. 9, 1996.

[51] Int. Cl.[7] ..... H01J 40/14

[52] U.S. Cl. ..... 250/214.1; 313/538

[58] Field of Search ..... 250/214 VT, 214.1, 250/214 LS; 313/533, 539, 540, 103 R, 104, 538

[56] References Cited

U.S. PATENT DOCUMENTS

| | | | |
|---|---|---|---|
| 2,821,637 | 1/1958 | Roberts et al. | 250/214 VT |
| 3,183,390 | 5/1965 | Grader et al. | 250/214 VT |
| 4,335,465 | 6/1982 | Christiansen et al. | 376/156 |
| 5,091,819 | 2/1992 | Christiansen et al. | 361/120 |
| 5,126,638 | 6/1992 | Dethlefsen | 315/326 |
| 5,146,141 | 9/1992 | Rohde | 315/326 |
| 5,399,941 | 3/1995 | Grothaus | 315/150 |
| 5,502,356 | 3/1996 | McGeoch | 315/111.91 |

FOREIGN PATENT DOCUMENTS

| | | |
|---|---|---|
| 39 42 307 | 4/1991 | Germany . |
| WO 94/03949 | 2/1994 | WIPO . |

*Primary Examiner*—Que T. Le

*Attorney, Agent, or Firm*—Jeffrey D. Myers; Rod D. Baker; Deborah A. Peacock

[57] ABSTRACT

The present invention is of a glow discharge switch operating in the low pressure regime where gas breakdown is limited by the distance between electron-gas particle collisions (pseudospark discharge). The invention utilizes linear discharge apertures (length greater than width) in the electrodes. The linear apertures provide significantly higher current conduction without discharge constriction than conventional round-hole pseudospark switches. A radial version of the linear pseudospark switch also is disclosed that provides for self-canceling of the magnetic fields induced by the discharge, and thus prevents discharge constriction and provides for very high current conduction.

51 Claims, 9 Drawing Sheets

LINEAR APERTURE PSEUDOSPARK SWITCH

CROSS-REFERENCE TO RELATED APPLICATIONS

This application claims the benefit of the filing of Provisional Application Ser. No. 60/021,411, entitled Linear Pseudospark Switch, filed on Jul. 9, 1996, and the specification thereof is incorporated herein by reference.

BACKGROUND OF THE INVENTION

1. Field of the Invention (Technical Field)

The present invention relates to glow discharge switching apparatuses and methods for high power applications.

2. Background Art

Switching is a major challenge for current and emerging military and commercial applications requiring both high switching speed and high power, such as:

Pulsed Lasers (including $CO_2$, excimer, and copper vapor lasers);

Electron-beam (E-beam) accelerators and X-ray machines;

Radar (including airborne, ship/ground-based, weather radars, and airport approach control radars);

Electric Guns;

Speed controls for high-power electric motors; and

Controls for high-electrical-power industrial processes featuring repetitive operation (such as assembly-line welding).

Switch requirements for such uses include high voltage and high current handling capability; robust design and high-temperature capability; stable operation for repetitive switch operation; long lifetime; and low maintenance. In general, future switching technology oriented to the above applications must handle voltage levels in the kV to hundreds of kV range, with amperage levels from tens of kA to mega-amperes, along with repetition rates up to 10 kilohertz (kHz). Switches must also offer low timing jitter, low switching delay times, low power loss and elevated-temperature operation.

At present, hydrogen thyratron tubes are the power switch most widely used for the applications noted above. While thyratrons are superior to competing switch designs like mechanical relay switches, solid-state switches and spark gaps, a significant drawback for thyratrons is their need for electrically heated cathodes for producing controlled emissions of cathode electrons. Control of these grids requires sensitive controls; also, grid design compromises are needed to accommodate conflicting electrical, thermal and mechanical requirements.

As a result, thyratrons are costly to produce. They also are difficult to scale up to higher powers. The most serious limitation to thyratrons is the relatively low peak current capability (10 kA typically) and the relatively low rate of rise of current (dI/dt). In addition, thyratrons cannot conduct large reverse current without damaging the anode. For those applications requiring simultaneous or precisely sequenced triggering of multiple switches, thyratrons are also inadequate because of the jitter in discharge ignition. Pseudospark switches provide solutions to many of these problems.

The conventional pseudospark switch was first reported by D. Bloess, et al., "The Triggered Pseudospark Chamber as a Fast Switch and as a High-Intensity Beam Source," *Nuclear Instruments Methods*, vol. 205, pp. 173–184 (1983), and a light activated version was taught by U.S. Pat. No. 4,771,168, to Gunderson. The authors describe a multigap "pseudospark" chamber for producing a controlled trigger mechanism for the fast switch.

The thyratron and "pseudospark" switches, generally operate in the low pressure regime where gas breakdown is limited by the distance between electron-gas particle collisions according to a law of electrophysics known as Paschen's law. Paschen's law defines the ability of gases to hold off a large voltage before "breakdown" and resuslting current flow as a function of the gas pressure and the spacing between electrodes. Paschen's law states that at high pressure, greater voltage standoff is achieved by moving the electrodes closer together. Experimental plots verifying Paschens law illustrate the region of operation of the pseudospark switch. FIG. 1 provides such an illustration, having the horizontal axis measured in the product of pressure times distance between anode and cathode or cathode and grid(pd) and the vertical axis measured in breakdown voltage. The Paschen curve bottoms out at about 7–13 mbar-mm, and as pressures are lowered below this range down to $10^{-3}$ Torr (a Torr equals approximately 1 mbar; 760 Torr equals one atmosphere pressure), the left side of the Paschen curve exhibits a sharp rise in the pressure-distance product. This means that to achieve greater voltage standoff in this region, the electrodes are moved closer together. This is region where the pseudospark switch operates. On this left side of the Paschen curve, by precisely lowering internal gas pressure within a gas filled tube, control of triggering may be maintained into the high voltage range. This is the parameter range in which a pseudospark switch operates. It is called a "pseudospark" because under these conditions discharge can be produced without collapse into a spark. Grid-controlled thyrotrons also operate on the left side of the Paschen curve in the lower valves of distance-pressure parameter.

A conventional round-hole pseudospark switch 10 has two metal plates 12 separated by an insulator 14 that is 1–3 mm thick (see FIG. 2). Each plate has a hole 16 (2–10 mm diameter) aligned with the hole in the opposite plate, with both holes coaxial with a similar hole in the insulator. Both plates and insulator operate inside a low-pressure housing (with pressures of several tenths of a Torr) containing gases such as hydrogen, nitrogen, helium, or argon. For commercial pseudospark devices, hydrogen is probably the best gas, thanks to the availability of low-leakage hydrogen reservoirs from the thyratron tube industry.

In round-hole pseudospark switches, the electrical breakdown voltage between a pair of parallel plates is a function of plate separation and gas pressure in the reservoir. For the pseudospark switch, the interelectrode gap is made to be about the same as the electron mean free path. Electrons then moving directly from electrode to electrode do not contribute to the ionization of the gas. A long path, however, is available the aligned apertures in the electrode plates to the back of the other electrode. This long path allows an electron to collide with the fill gas, resulting in a plasma. The switch discharge is triggered by generating or injecting electrons into the cathode plate with a laser, ultraviolet (UV) sources, flashlamps, or auxiliary electrode. The triggered electrons are accelerated through the hole in the cathode plate toward the anode plate, during which they collide with gas molecules to generate secondary electrons and ions. The secondary electrons travel toward the anode plate, generating additional collisions and secondary electrons. Meanwhile, the secondary-emission ions travel toward the cathode and impact it, generating electrons that in turn are swept toward the anode. As these high-energy electrons strike the anode, ions are released which travel back to collide with that cathode. These interactions generate a low-resistance plasma of electrons and ions, propagating through the aperture and connecting the backs of the electrode plates. This plasma conducts electricity, thereby producing closing-switch action. Because the plasma is diffuse, it does not erode the electrodes, ensuring long electrode lifetimes. Concurrently, the plasma discharge passage through the holes in the electrodes constricts it, increasing the plasma's temperature. In turn, this temperature rise lowers the resistance of the discharge, resulting in low switch losses.

Round-aperture pseudospark switches cannot be scaled to high power levels by increasing the radius of the aperture. Theoretical modeling indicates that increasing gap aperture reduces the switch's self-breakdown voltage (i.e., self-triggering) threshold. Lehr, J., et al., "The Linear Pseudospark: A High Current Pseudospark Switch," 1995 IEEE Pulsed Power Conference, Albuquerque, N. Mex. (July 1995). FIG. 3 shows the breakdown voltage as a function of hole radius for a conventional round hole pseudospark switch. Note that the breakdown potential goes to very low voltage as the hole radius increases for a specific pressure. Increasing the aperture makes the resulting discharge unstable and the switch ceases to function as a diffuse discharge and instead, collapses to an arc and then functions as a standard conventional spark gap with high electrode erosion and low voltage standoff.

Analysis and experiments of conventional round hole pseudospark switches indicate that the switch functions because of the peculiar field shaping produced by the roundness of the hole. A recent paper reviewing the state-of-the-art in pseudospark switches addressed the need for higher current capability. Frank, J., "Progress in Pseudospark Switch Development," 10th IEEE International Pulsed Power Conference, Albuquerque, N. Mex. (July 1995). The state-of-the-art according to Frank involves using several holes instead of a single hole to get an increase in current capability. Even with this configuration, Frank shows evidence of magnetic pinching, forcing all of the current to eventually flow through one hole which increases the erosion of the switch thereby reducing the lifetime. Bergmann has operated a version of the multiple-round aperture pseudospark switch with the holes arranged on the circumference of a circle so the switch current flows in the radial direction to reduce magnetic field pinching effects.

Meanwhile, several promising commercial applications of pulse power have emerged that highlight the performance and design limitations of current thyratrons switches and the demand for new switch technology. For example, high power particle beam accelerators require high low inductance, long current switches that are triggerable—requirements that are beyond the capabilities of thyratrons or spark gaps.

Thyratrons, moreover, due to the need for a physical grid, have a higher discharge losses; and the grid and cathode (even in cold cathode switches) experience degradation and limited life. Also, triggering by means of a physical grid interposed between the anode and cathode requires the use of an electrode trigger which is electrically coupled to the controlled high powered circuit. This electrical coupling of the controlled main high voltage circuit to the trigger necessarily introduces inherent safety problems.

SUMMARY OF THE INVENTION (DISCLOSURE OF THE INVENTION)

The present invention is of a pseudospark switch and a method of producing a pseudospark discharge, comprising: providing a plurality of linear electrode apertures to electrodes; providing a voltage to drive conduction of current; and providing an event to initiate current conduction, the event selected from the group consisting of application of an energy trigger and application of a voltage exceeding a self break limit. In the preferred embodiment, the apertures are slots, preferably with aspect ratios of length greater than width, and linear or curvilinear. A multiple gap switch may be formed by providing apertures to three or more electrode plates, each a linear aperture, with the apertures completely aligned or only partially aligned. A radial switch may be formed by causing electron current flow to be radial between two sets of curvilinear slots upon initiation of current conduction. If the slots are staged in series, a two-dimensional flat or curved current sheet, or a three-dimensional current sheet, may be formed (such as for producing light). The event producing the discharge may be by an electrical trigger utilizing a secondary discharge or emission site, or a pulse of electromagnetic radiation (such as light or x-ray). A microwave cavity may be provided for production of microwaves by the switch, an auxiliary magnetic field may be used to assist in control of discharge, and a convolute anode/cathode structure may be provided to shield an insulator from direct line-of-sight of discharge of the switch.

A primary object of the present invention is to provide a pseudospark switch having a linear (length greater than width) aperture or plurality of apertures, permitting switches with increased current carrying capacity with low inductance, diffuse (i.e., low erosive) discharges, and extended lifetime when compared to conventional designs. Both single and multiple-gap switches are presented by the invention.

A primary advantage of the present invention is that multiple-gap switches may be employed, with either complete or partial alignment of the gaps, permitting many additional effects vis-a-vis the conventional round-aperture pseudospark switch.

Another advantage of the present invention is that the discharge spreads evenly throughout the slot area through a process of self-photoionization.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention is of a linear aperture pseudospark switch that employs a linear (e.g., linear) discharge aperture in place of the round aperture used in conventional (round aperture) pseudospark switch designs. This invention permits increased current carrying capacity with low inductance, and extended lifetime when compared to conventional designs. Both single and multiple-gap switches are presented by the invention. Dispensing with a single or multiple round hole in favor of a continuous elongated hole or slot allows the discharge to spread evenly throughout the slot area through a process of self-photoionization.

Figure 1:
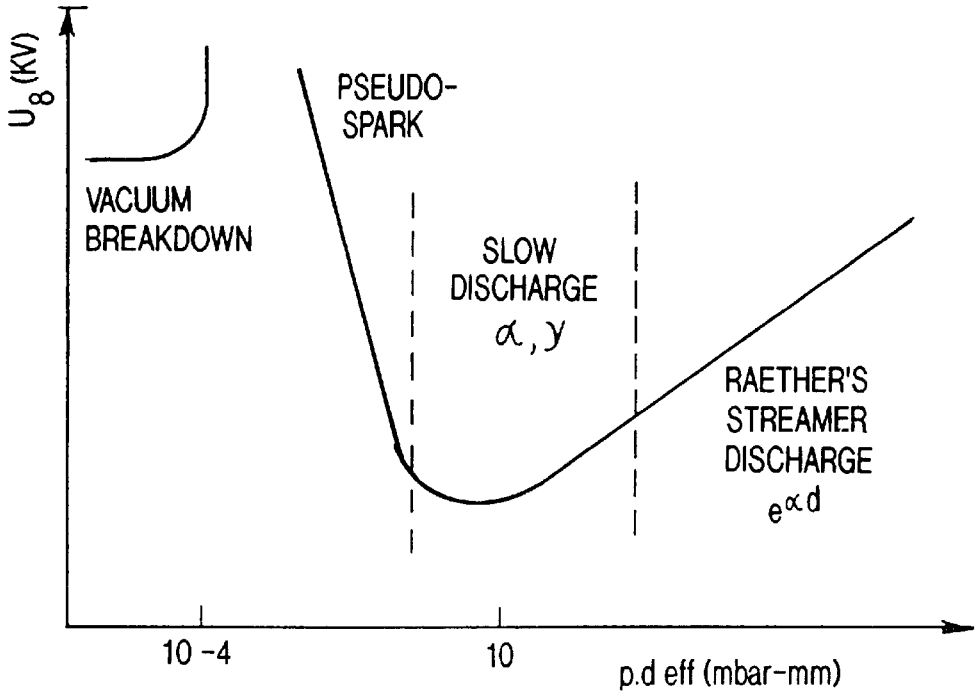
FIG. 1 illustrates a Paschen-curve (prior art) representing the breakdown behavior of gas filled two plane parallel electrode configurations.

FIG. 1 shows the breakdown voltage as a function of the product of the gas pressure and the electrode spacing. This Paschen curve shows the region of a conventional glow discharge operation and the region for the operation of the pseudospark.

Figure 2:
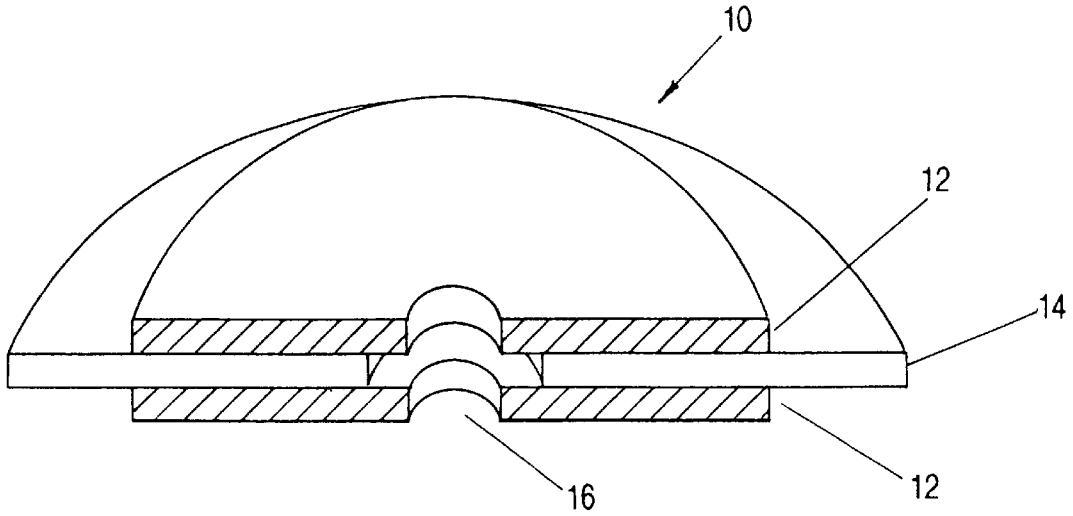
FIG-2 PRIOR ART
FIG. 2 is a cutaway section view of a prior art round aperture pseudospark switch.

FIG. 2 shows a cutaway section of a conventional pseudospark switch 10. The switch is formed by two metallic plates 12 with a round aperture 16 in the center of each plate, the two plates being separated by an insulator 14. The two plates are then placed in a chamber (not shown) and to which a gas of a specific composition (often hydrogen gas) is introduced and maintained in a specific pressure.

Figure 3:
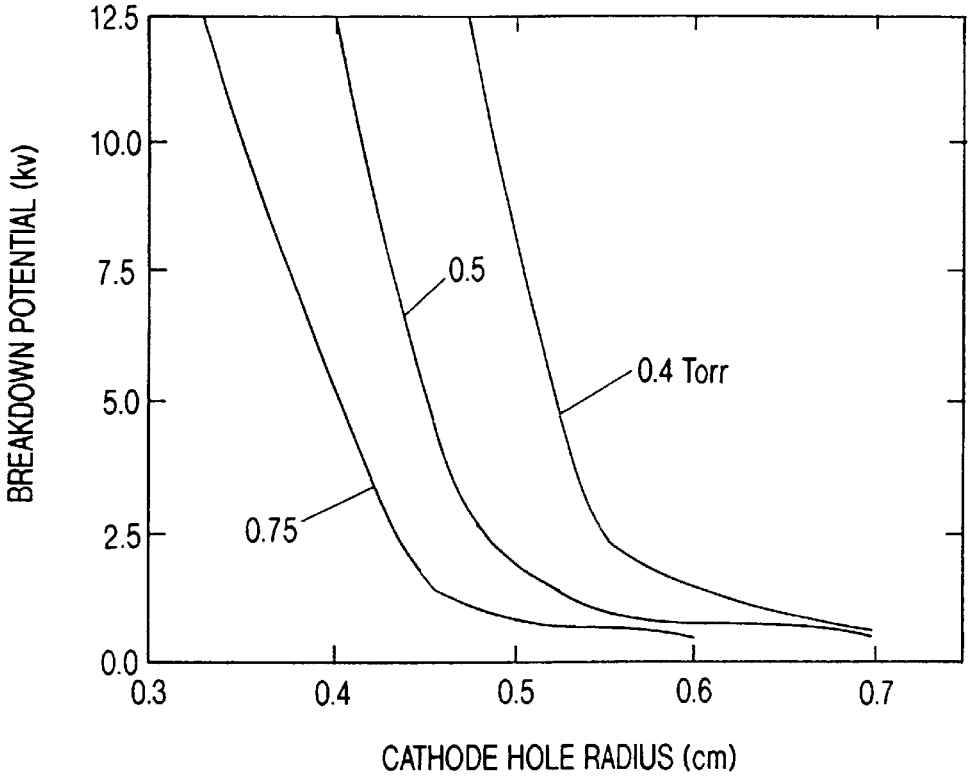
FIG. 3 is a plot of breakdown voltage versus hole radius for a prior art round aperture pseudospark switch.

FIG. 3 shows the breakdown voltage as a function of hole radius for a conventional round hole pseudospark switch. Note that the breakdown potential goes to very low voltage as the hole radius increases for a specific pressure.

Figure 4:
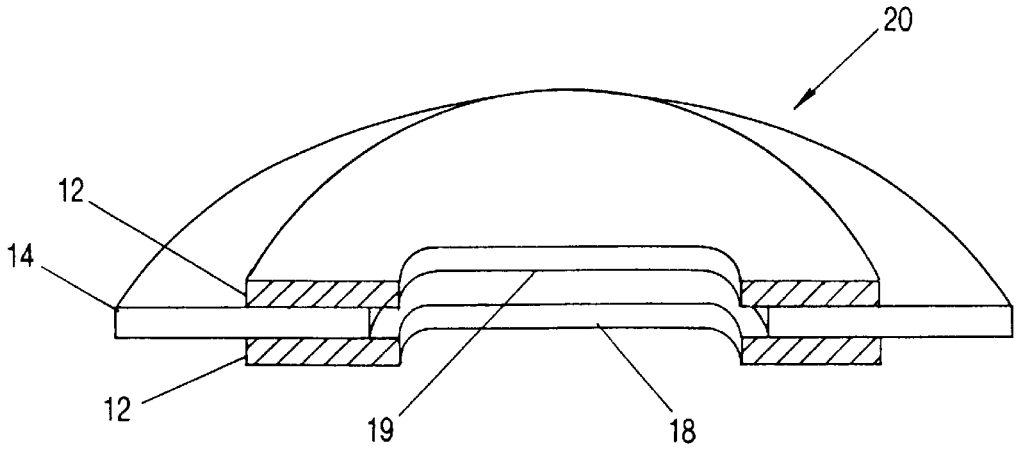
FIG. 4 is a cutaway section view of the linear pseudospark switch embodiment of the invention.

FIG. 4 shows a drawing of the linear pseudospark switch 20 embodiment of the invention. It is formed by two plates 12 with a linear aperture 18 whose length is greater than its width formed in each plate. The two plates are separated by an insulator 14. Two plates are then installed in a chamber (not shown) that is then filled with the gas (often hydrogen) at a specific pressure. High voltage is connected to one plate and the other plate is connected to the load. When the plate is triggered by any one of a number of mechanisms, including irradiation by ultraviolet light, then the switch conducts. The discharge 19 is between the plates 12 and forms a sheet of current because of the linear geometry of the aperture 18.

Figure 5:
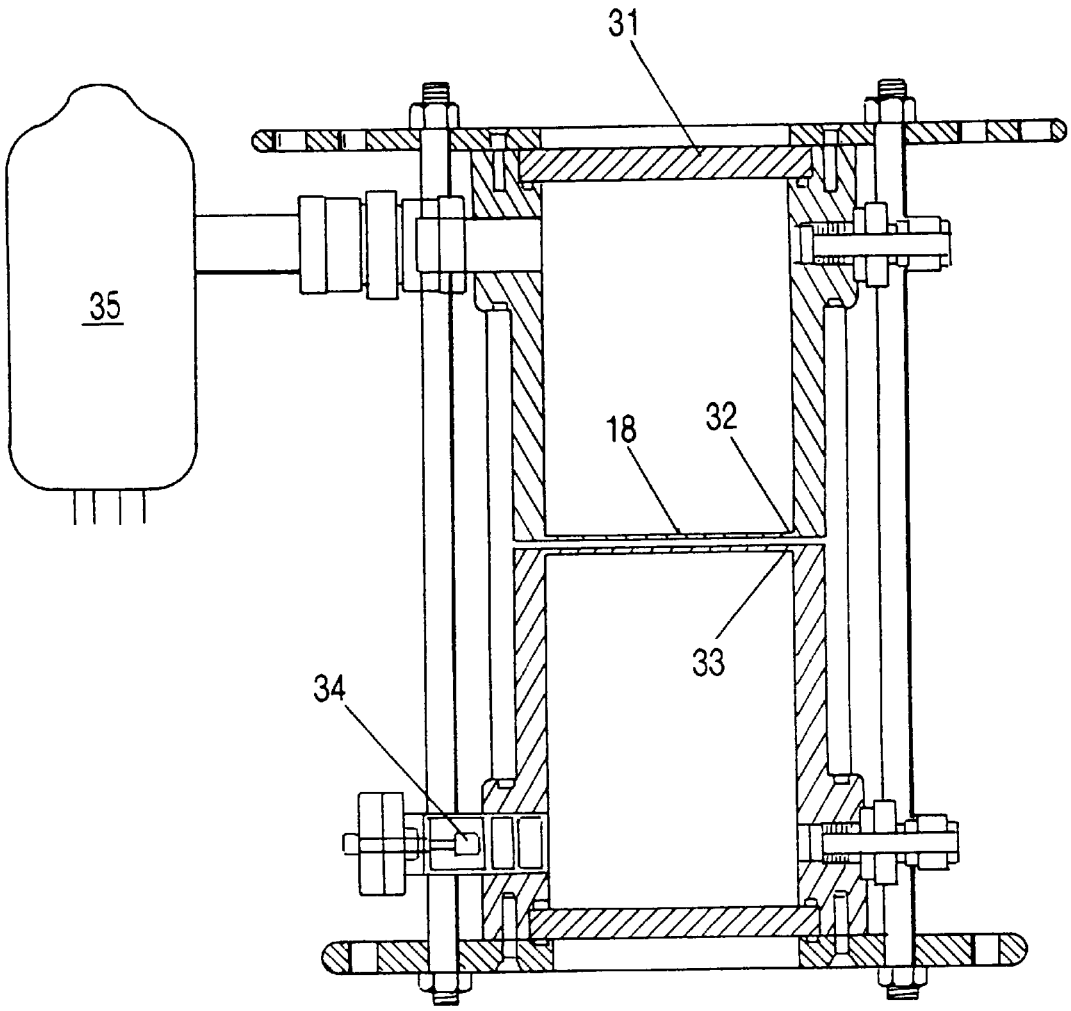
FIG. 5 is a cross-section view of the single-gap linear pseudospark switch embodiment of the invention.

FIG. 5 is a cross-section of a single-gap linear pseudospark switch 30 of the invention. The quartz window 31 used to determine uniformity of the discharge is shown, as is the anode 32 and the cathode 33. The linear slot 18 is in the plane of the paper, and current flow is in the plane of the paper. The vacuum port 34 for controlling pressure in the switch is shown, as in the ion gauge 35 used to measure pressure.

Figure 6:
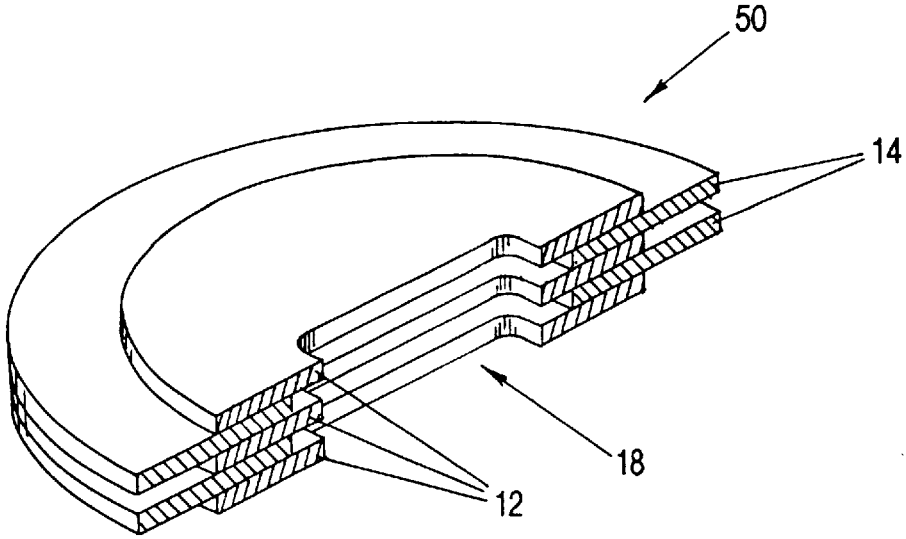
FIG. 6 is a perspective cutaway view of the multi-gap linear pseudospark switch embodiment of the invention.

FIG. 6 shows a multi-gap linear pseudospark switch 50 of the invention whereby several linear pseudospark switches in series are formed by several plates 12 with rectangular apertures 18 separated by insulators 14.

Figure 7:
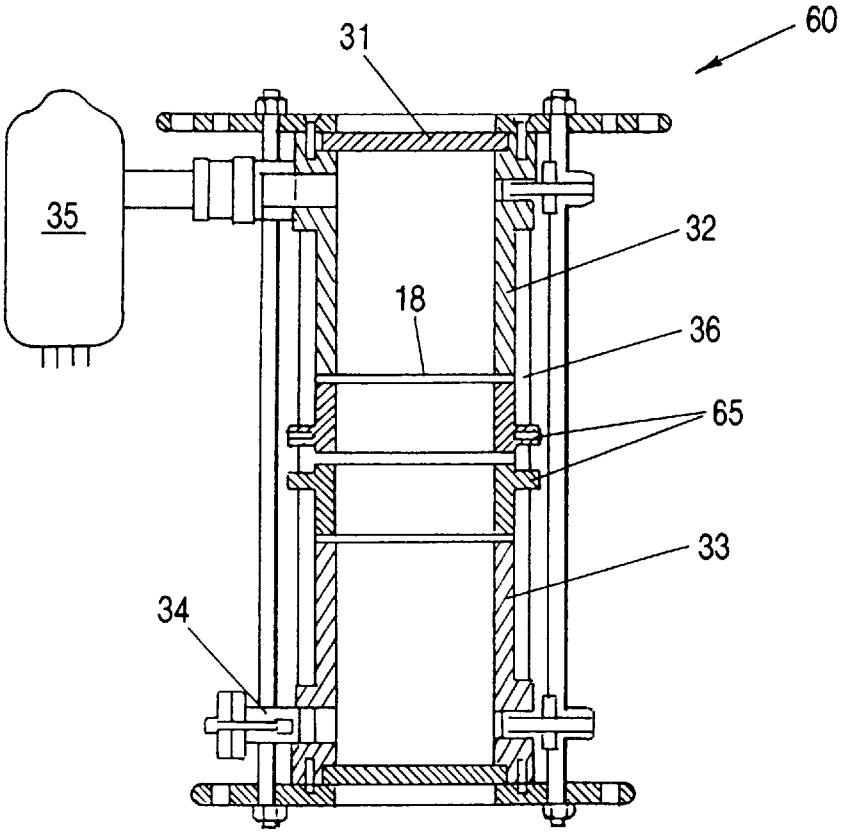
FIG. 7 is a cross-section view of the double gap linear pseudospark switch of the invention.

FIG. 7 shows a cross-section of a double-gap linear pseudospark switch 60 of the invention. The quartz window 31 was used to determine uniform filling of the discharge slots 18. As in FIG. 5, the linear slot 68 is in the plane of the paper, and current flow is in the plane of the paper. The intermediate electrodes 65 are shown as are the cathode 33 and anode 32, with glass insulator 36, ion gauge 35, and vacuum port 34.

Figure 8:
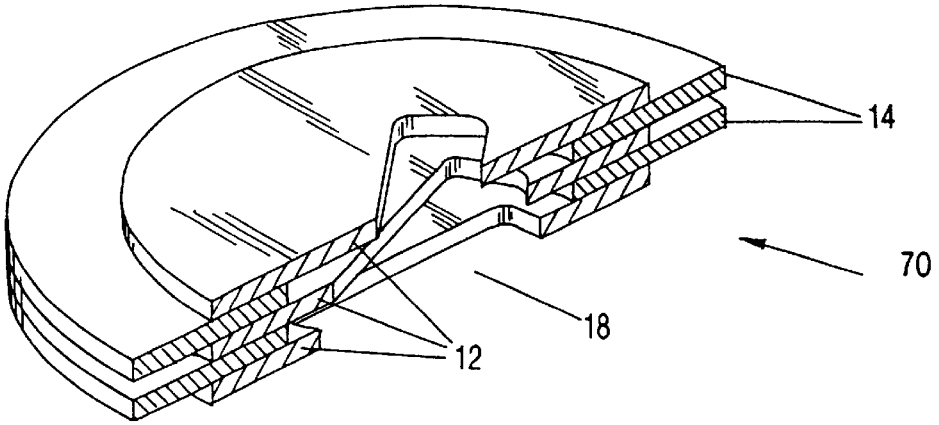
FIG. 8 is a perspective cutaway view of the multi-gap linear pseudospark switch embodiment of the invention with non-aligned gaps.

FIG. 8 shows a multi-gap linear pseudospark switch 70 of the invention in which the apertures 18 are only partially aligned, thus providing a linear sheet of current with a twist.

Figure 9:
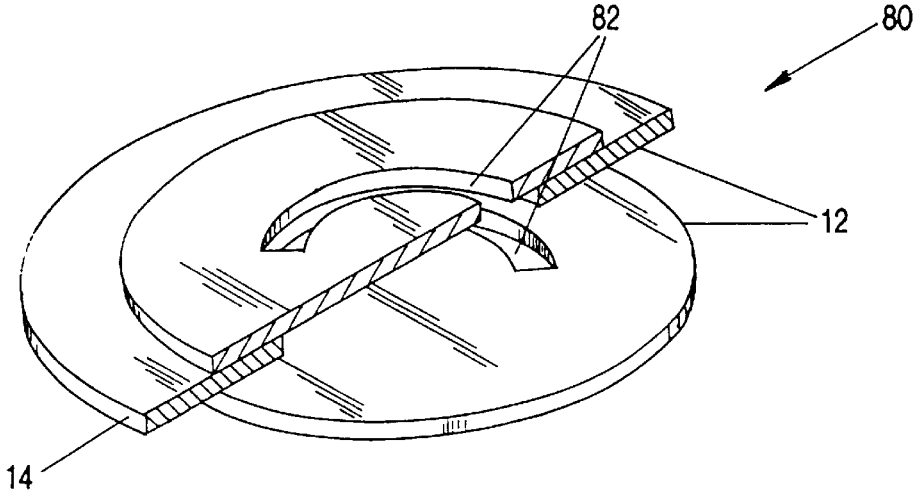
FIG. 9 is a perspective cutaway view of the curved slot linear pseudospark switch embodiment of the invention.

FIG. 9 shows a linear pseudospark switch 80 of the invention in which the apertures 82 on each plate 12 are curved.

Figure 10:
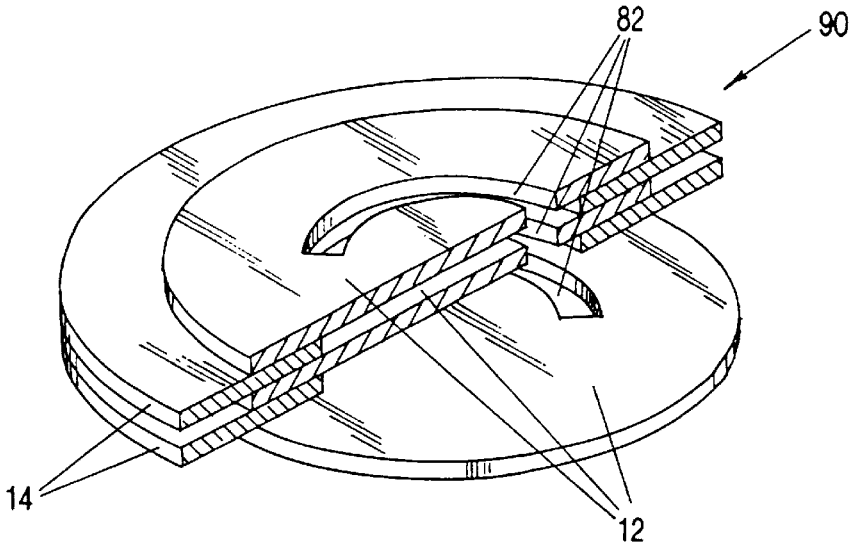
FIG. 10 is a perspective cutaway view of the multi-gap curved slot linear pseudospark switch embodiment of the invention.

FIG. 10 shows a multi-gapped curved slot linear pseudospark switch 90 of the invention where several linear pseudospark switches in series are formed by several plates 12 with linear apertures 82 separated by insulators 14.

Figure 11:
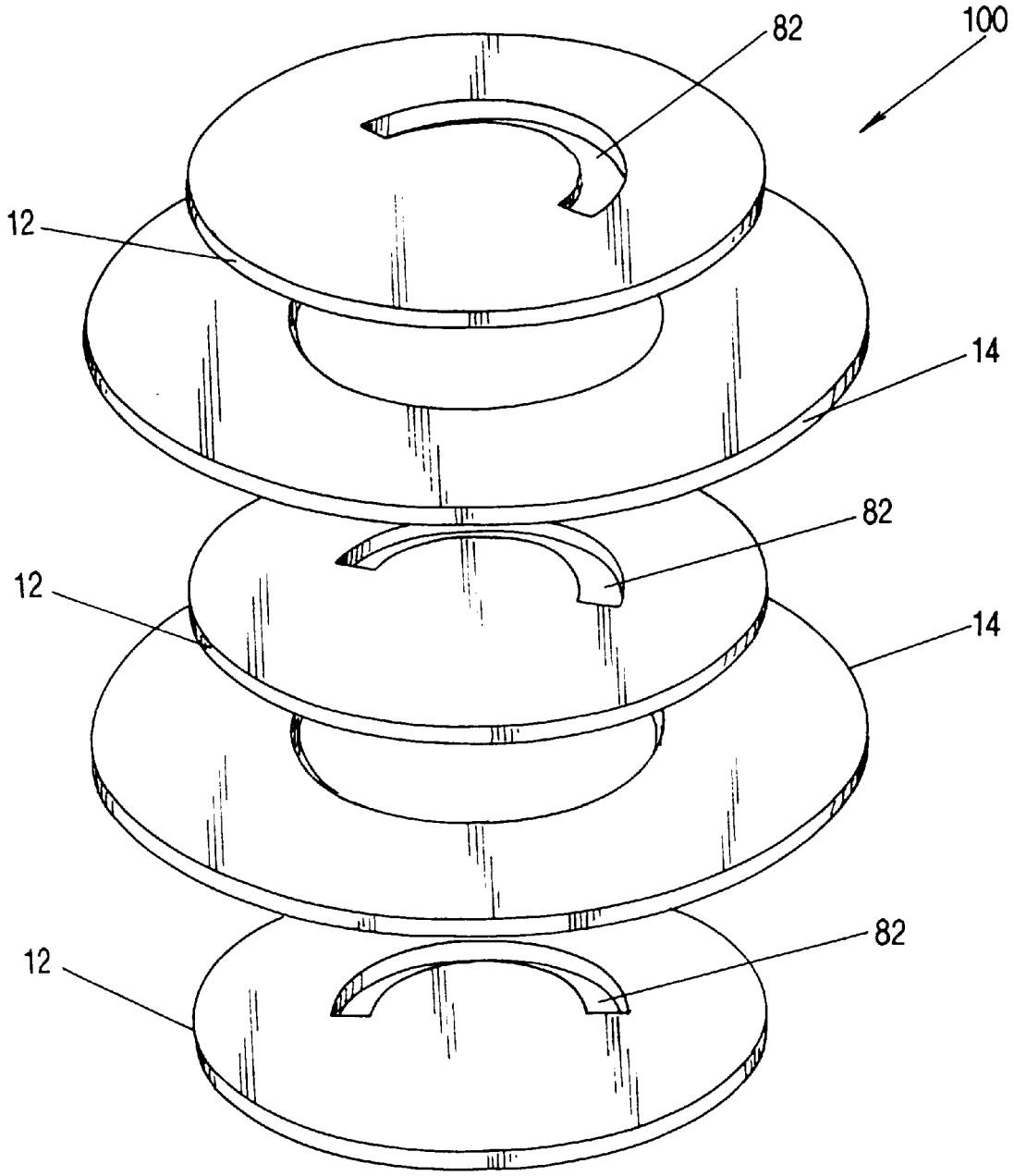
FIG. 11 is a perspective exploded view of the non-aligned multi-gap curved slot linear pseudospark switch embodiment of the invention.

FIG. 11 shows a multi-gapped curved slot linear pseudospark switch 100 of the invention whereby the slots 82 are only partially aligned, thus forming a three-dimensional curved current sheet with twist.

Figure 12:
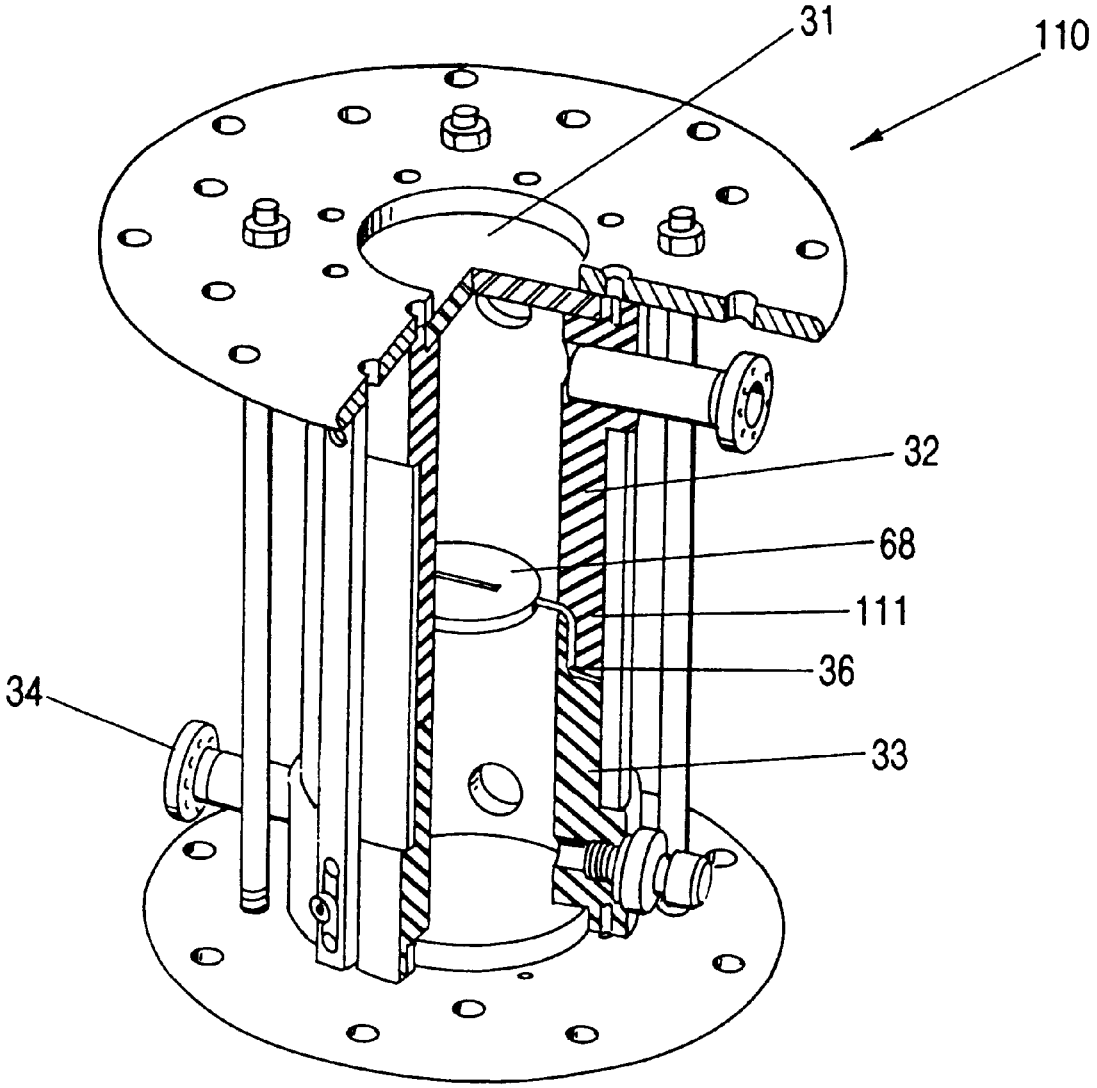
FIG. 12 is a cut-away view of the convolute insulator linear pseudospark switch embodiment of the invention.

A perspective cutaway view of a convolute anode/cathode linear pseudospark switch 110 with shielded is given in FIG. 12. All of the key components are the same as the other switches, with the primary difference being in the anode and cathode designs. Notice how the cathode 33 is recessed into the anode 32 forming convolute 111, alleviating a direct line-of-sight from discharge to insulator 36. Greater than 50 kA has been achieved with this design in the laboratory, together with uniform discharge and long lifetime.

Figure 13:
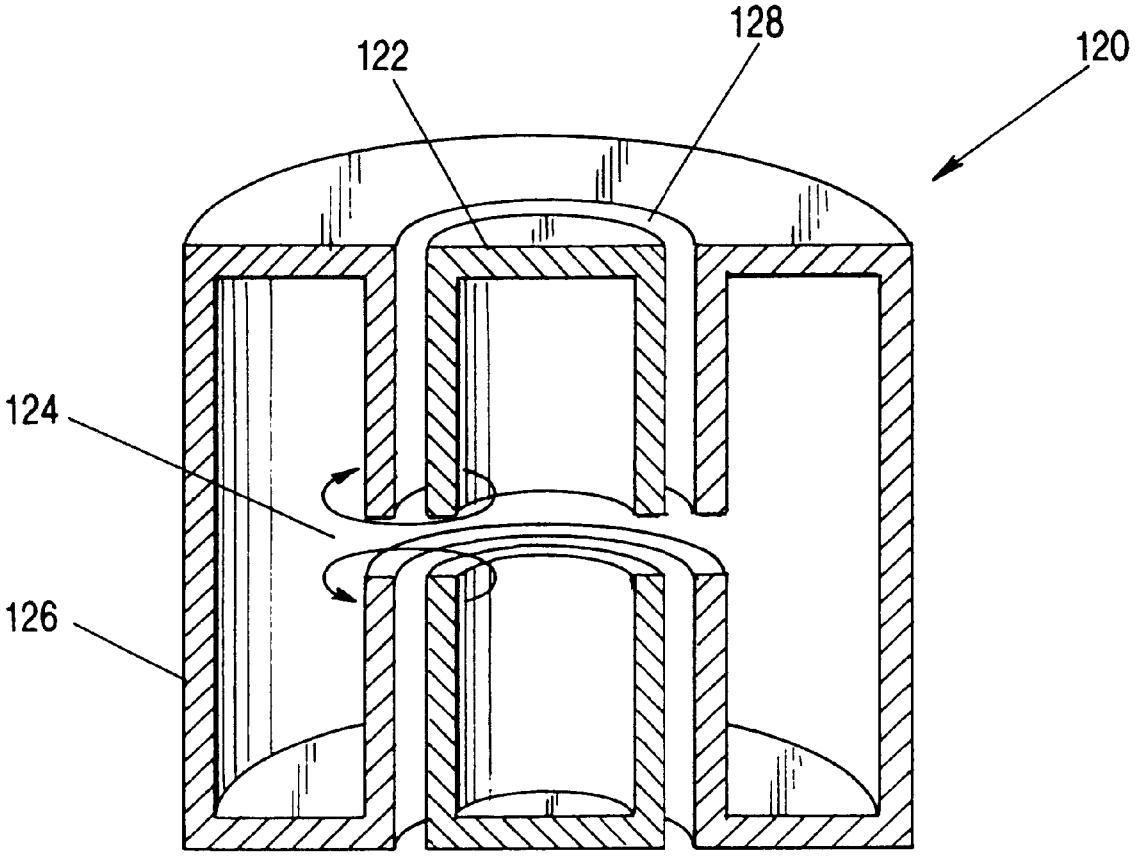
FIG. 13 is a perspective cutaway view of the radial pseudospark switch embodiment of the invention.

FIG. 13 illustrates the radial pseudospark switch 120 of the invention. The electron trajectories 124 are shown flowing from the back of the cathode 122 through the slot 128 to the back of the anode 126. Note that the slot forms a complete circle, and that the current flow is radially from the inner cathode to the outer anode. The polarity may be reversed with electron flow from the outer cathode to the inner anode.

Figure 14B:
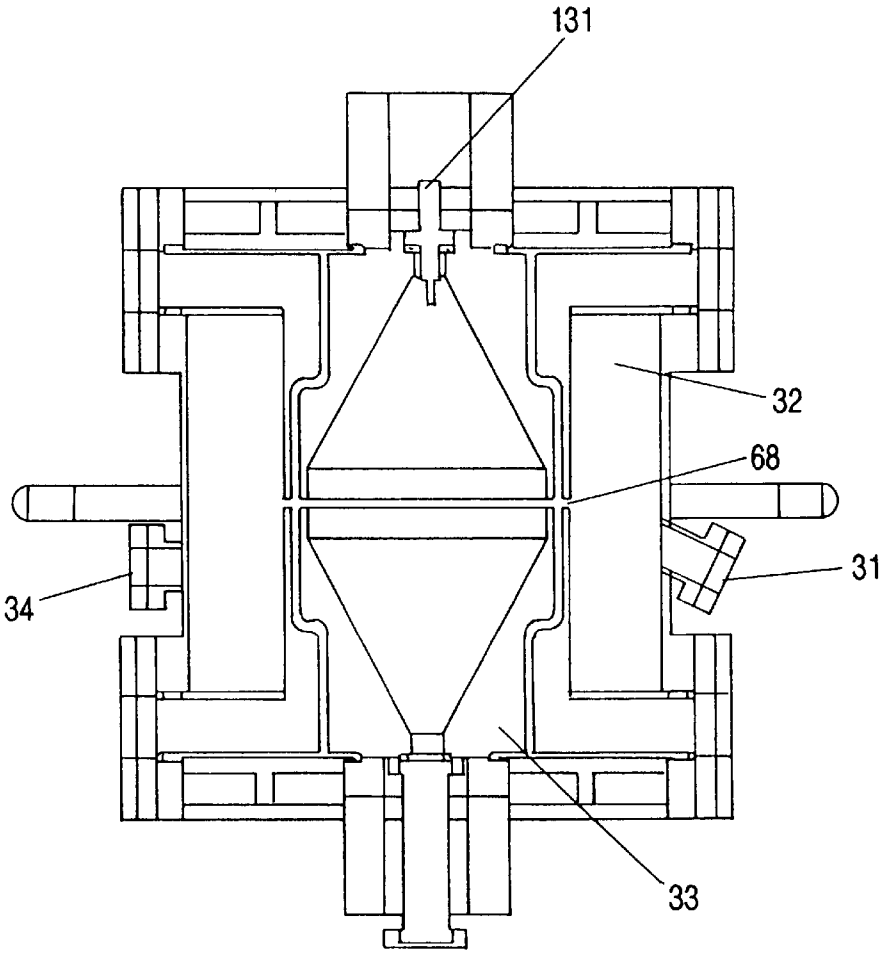
FIGS. 14(*a*) and (*b*) are cut-away views of the radial pseudospark switch embodiment of the invention.
Figure 14A:
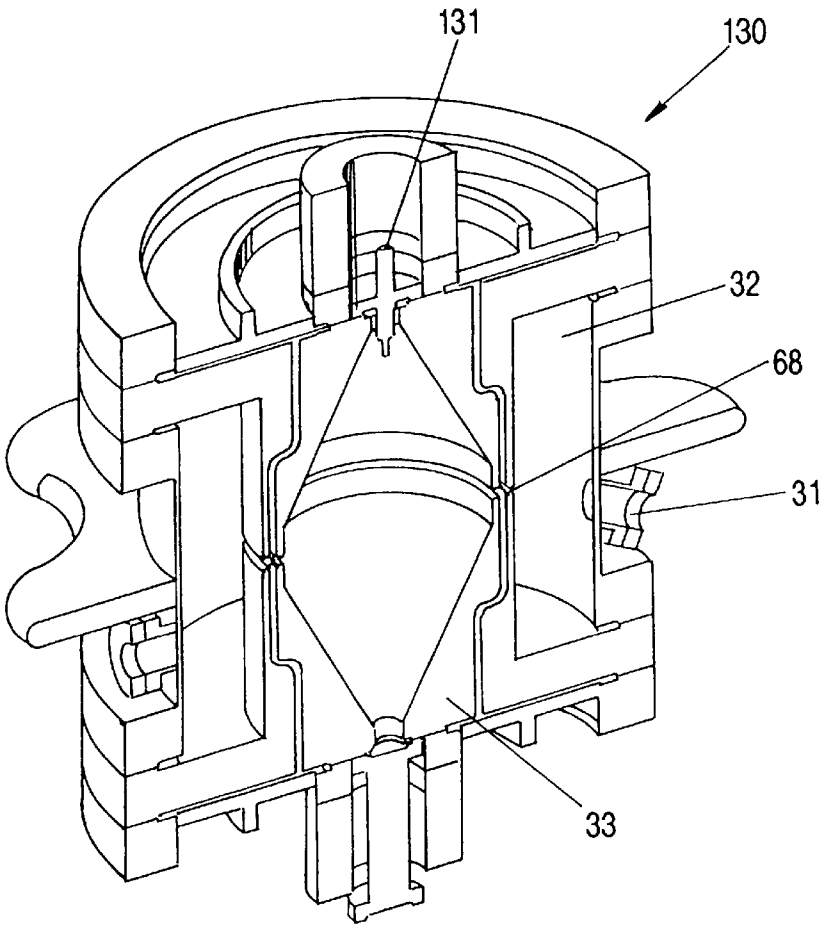

FIGS. 14(*a*) and (*b*) are cut-away views of the radial pseudospark switch 130 embodiment of the invention. Multiple quartz windows 31 for viewing the discharge, the cathode 33, anode 32, and discharge slot 68 are shown, along with the trigger pin 131.

The linear aperture pseudospark switch of the invention dispenses with a single round hole in favor of, preferably, a continuous elongated hole or slot. The slot and face geometry allows the discharge to spread evenly throughout the slot area through a process of self-photoionization. FIG. 5 shows a cross-section of a typical laboratory linear pseudospark switch. The linear slot is located in the center of the page, with current flow occurring in the plane of the page. Operation of this switch at 55 kA conduction current with standoff voltages of 25 kV have been achieved. Photographic evidence establishes complete filling of the linear slot. Switches have been tested with a gap of 0.4 cm and aperture lengths of 3 cm. Theoretical analysis shows that a long linear aperture offers the same voltage holdoff as a round aperture switch, if the width of the slot is approximately 70% of the round aperture diameter. Laboratory tests of the self-breakdown voltage characteristics for several linear pseudoswitches have verified these results.

Linear pseudospark switches with aperture lengths of 3 cm demonstrate uniform and stable discharge, with vacuum hold-off voltages exceeding 35 kV. This is consistent with modeling studies for both 0.5-inch and 1.0-inch slot lengths which indicate that, under worst-case conditions, ionization densities during breakdown will vary less than one order of magnitude. This predicted that uniform slot discharges are possible with slots up to at least 2.5 cm long. Discharges of 3 cm in length were operated without pinching.

An attractive and unexpected performance feature of the invention is that switch discharges uniformly fill the slot even during self-break operation. This discharge uniformity allows the switch to operate passively, opening up additional applications, such as crowbar switches for protecting high-energy systems and for use as lightning arrestors. The very precise triggering that linear aperture pseudosparks switches offer also means that multiple switches operating in parallel can be used for certain applications like nuclear-effects simulators or other applications requiring precisely sequenced pulsed power.

It is feasible to stack multiple linear aperture pseudospark switches on top of each other for additional voltage holdoff, as shown in FIG. 6. In this situation, several linear aperture pseudospark switches are stacked together. Laboratory experiments have shown that the holdoff voltage scales approximately as the number of gaps. Thus, a nominal 30 kV switch can be scaled to 60 kV by utilizing two gaps instead of one.

FIG. 7 is a cross-section of a double-gap linear pseudospark switch. As in FIG. 5, the linear slot is parallel to the plane of the page, and current flow is in the plane of the page. This switch held off 40 kV (twice the standoff voltage for a single gap operating at the same pressure), and conducted 72 kA with uniform discharge. For certain situations, it is desired to twist the current sheet, especially for those applications where the current in the switch it utilized as an electron source. By simply rotating the central axis of the gaps, the current sheet can be twisted to produce this effect, as shown in FIG. 8. Under certain circumstances, additional current can be achieved by turning the gap in a circle. FIG. 9 shows the curved slot linear aperture pseudospark switch which provides certain advantages in the control of the magnetic field in the discharge, and also provides a curved source of ultra-violet light or electrons for certain applications. The plates with curved slot can also be stacked for additional voltage holdoff as shown in FIG. 10, and the curves can be configured in such a way as to provide a twist to the current sheet, as shown in FIG. 11. These various configurations all illustrate the versatility of the linear pseudospark switch technology.

One problem with linear aperture pseudospark switches operating at high currents is the metal vapor deposited on the glass insulator that is used to separate the plates. The insulator may become metallized after several shots, enhancing the electric field around the edge of the switch ultimately leading to edge breakdown. An alternate switch design can be used to overcome this problem, as shown in FIG. 12. A convolute anode/cathode structure is used to shield the insulator from direct line-of-sight of the discharge that is, so light and debris from the discharge does not deposit on the surface of the insulator. This same technique of convolute insulator design can be used with multigap switches, curved slot switches, and radial switches and other insulators in the switch.

It was mentioned previously that one of the limitations to the current conduction capability of the linear pseudospark switch is self-pinching of the discharge where the discharge bunches against one end of the slot, constricting the discharge and causing high electrode erosion. Self-pinching may be suppressed by rotating the slot into a circle so that the slot has no end, as shown in FIG. 13, and then the magnetic self-pinching forces will be self-cancelling as a result of the geometry. It is called a radial discharge because the current flow is in the direction of a radius from the axis of the cylinder, as shown in FIG. 13. This design provides for very high current flow without pinching and with minimum electrode erosion. Such a radial pseudospark switch operates at 460 kA and 140 coulombs charge transfer per shot for many shots with minimal electrode erosion and no evidence of current pinching.

Industrial Applicability

The invention is further illustrated by the following non-limiting examples. Note also that certain embodiments discussed earlier in this application underwent laboratory testing.

Example 1

The following applications are made possible by the unique features of the linear aperture and radial pseudospark switches. Conventional pseudospark switches and conventional thyratrons do not have the capability of accomplishing these applications because of either of the inability to handle high rates of rise of current or the inability to handle the peak current.

X-Ray Simulator Switches. There is great interest in the United States in the on-going development of x-ray simulators that produce bursts of x-radiation to simulate the radiation received from a nuclear weapons event. These devices typically require switches capable of conducting 1 MA or more. An example of such an accelerator is the DECADE accelerator currently under construction by the Defense Special Weapons Agency (DSWA). The use of the linear pseudospark switch for x-ray simulators would enable the elimination of one intermediate energy storage section and provide improved performance at lower cost. Conventional switches are not capable of handling the high current requirements and fast current rise time (low inductance) requirements of this application.

High Power Accelerators. There is a family of switches needed for high power accelerators that requires high current conduction of 500,000 amps or more but with low voltage standoff in the 30 to 40 thousand volt range. Conventional round hole pseudospark switches are not capable of filling this need. However, the linear aperture pseudospark switch has the capability of conducting at current levels of this magnitude at the standoff voltages and being capable of low manufacturing costs, as demonstrated by the 460 kA operation of the radial pseudospark switch emodiment of the invention in the laboratory.

Copper/Vapor/Excimer Lasers. Copper, vapor, and excimer pulsed electric lasers require high peak currents because of the low discharge impedance and high rate of rise of current in order to ensure stable and uniform discharge formation. Current modulator technology requires the use of saturable magnetic switches placed between a conventional thyratron or pseudospark switch and the laser electrodes because neither the conventional pseudospark switch or the thyratron have the capability of providing the high rate of current rise required by the laser. The magnetic switch allows the current rise to be very rapid at the laser but slow at the thyratron switch thus, enabling the conventional thyratron or pseudospark switch to fire the laser. The linear aperture pseudospark switch enables these laser modulators to be built without the magnetic switches, thus reducing cost and reducing complexity of the system.

Focused Shock Drill. U.S. Pat. No. 4,741,405 teaches drilling oil wells and other wells using focused pressure waves created by pulsed currents discharged in water. One of the key technologies for drilling deep wells at large diameter is the availability of high current, low inductance switches that do not require auxiliary power sources for triggering capabilities. The linear aperture pseudospark switch may prove to be an enabling technology for moderate diameter (8–12 inch deep) 1 km deep applications of the focused shock drilling technology. The linear aperture pseudospark switch offers the capability of optical triggering along with the conduction of currents in the 0.5 to 1 MA range. This capability cannot be met by the conventional round-hole pseudospark switches.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An electronic glow discharge switch, operating on the low-pressure side of the minimum of the Paschen curve, capable of withstanding high voltage, comprising:

at least one anode plate having a first linear aperture wherein the length of said aperture is greater than the width of said first linear aperture;

at least one cathode plate having a second linear aperture wherein the length of said second linear aperture is greater than the width of said second linear aperture;

said anode and cathode plates disposed substantially mutually parallel and adjacent said plates separated by a gap;

an insulator in said gap for separating said adjacent plates, wherein a glow discharge operates between adjacent said plates through said apertures to conduct current in the switch;

means for initiating said glow discharge;

housing means to support and seal said plates; and gas contained within said housing.

2. The switch of claim 1 wherein said plates are substantially flat.

3. The switch of claim 2 wherein each of said linear apertures is straight along its length.

4. The switch of claim 2 wherein each of said linear apertures is curved along its length.

5. The switch of claim 1 further comprising at least three plates, each plate defining a linear aperture.

6. The switch of claim 1 wherein said apertures are completely aligned.

7. The switch of claim 1 wherein said apertures are partially aligned.

8. The switch of claim 5 wherein said apertures are completely aligned.

9. The switch of claim 5 wherein said apertures are partially aligned.

10. The switch of claim 1 wherein said plates are curved.

11. The switch of claim 10 wherein said apertures are completely aligned.

12. The switch of claim 10 wherein said apertures are partially aligned.

13. An electronic radial glow discharge switch, operating on the low-pressure side of the minimum of the Paschen curve, capable of withstanding high voltage, comprising:

at least one anode plate having a first linear aperture wherein the length of said aperture is greater than the width of said first linear aperture;

at least one cathode plate having a second linear aperture wherein the length of said second linear aperture is greater than the width of said second linear aperture;

wherein said anode and cathode plates comprise cylinders concentrically disposed co-axially and separated by a gap;

an insulator in said gap for separating said plates, wherein a glow discharge operates between said plates through said apertures to conduct current in the switch radially from said co-axis;

means for initiating said glow discharge;

housing means to support and seal said plates; and gas contained within said housing.

14. The switch of claim 13 wherein said apertures are aligned in a plane substantially normal to the co-axis of said cylinders.

15. The switch of claim 13 wherein said apertures are partially aligned with respect to a plane substantially normal to the co-axis of said cylinders.

16. An electronic glow discharge apparatus, operating on the low-pressure side of the minimum of the Paschen curve, comprising:

at least one anode plate having a first linear aperture wherein the length of said aperture is greater than the width of said first linear aperture;

at least one cathode plate having a second linear aperture wherein the length of said second linear aperture is greater than the width of said second linear aperture;

said anode and cathode plates disposed substantially mutually parallel, and adjacent said plates separated by a gap;

an insulator in said gap for separating said adjacent plates, wherein a glow discharge operates between adjacent said plates through said apertures to conduct current in the apparatus, said glow discharge forming a sheet of current;

means for initiating said glow discharge;

housing means to support and seal said plates;

gas contained within said housing; and at least one window in said housing.

17. The apparatus of claim 16 wherein said plates are substantially flat.

18. The apparatus of claim 17 wherein each of said linear apertures is straight along its length.

19. The apparatus of claim 18 wherein said apertures are substantially aligned and said current sheet is flat.

20. The apparatus of claim 18 wherein said apertures are partially aligned and said current sheet is twisted.

21. The apparatus of claim 17 wherein each of said linear apertures is curved along its length.

22. The apparatus of claim 21 wherein said apertures are substantially aligned said current sheet is curved.

23. The apparatus of claim 21 wherein said apertures are partially aligned and said current sheet is twisted.

24. The apparatus of claim 16 comprising at least three cathode and anode plates, each plate defining linear aperture therein.

25. The apparatus of claim 16 wherein said plates are curved.

26. The apparatus of claim 21 wherein said anode and cathode plates comprise cylinders concentrically disposed co-axially, with said apertures substantially aligned in a plane substantially normal to the co-axis of said cylinders.

27. The apparatus of claim 16 wherein said current sheets produce electrons exiting said window.

28. The apparatus of claim 16 wherein said plates are convoluted to shield said insulator from direct line-of-sight exposure to said glow discharge, thereby to reduce deposition of light and metal vapor upon said insulator.

29. The apparatus of claim 16 wherein said means for initiating comprises means for exceeding the breakdown electric field in said gap.

30. The apparatus of claim 16 further comprising means for triggering at a voltage below the self break threshold.

31. The apparatus of claim 30 wherein said means for triggering comprises an electrical trigger utilizing a secondary discharge.

32. The apparatus of claim 30 wherein said means for triggering comprises a pulse of electromagnetic radiation.

33. The apparatus of claim 32 wherein said means for triggering comprises a pulse of light.

34. The apparatus of claim 32 wherein said means for triggering comprises a pulse of x-ray radiation.

35. A method of switching high current in a high-voltage electrical circuit, comprising the steps of:

(a) initiating an electronic glow discharge on the low-pressure side of the minimum of the Paschen curve between at least one anode plate having a first linear aperture wherein the length of said aperture is greater than the width of said first linear aperture, and at least one cathode plate having a second linear aperture wherein the length of said second linear aperture is greater than the width of said second linear aperture;

(b) disposing said plates substantially mutually parallel, and separating adjacent said plates by a gap;

(c) separating said adjacent plates with an insulator in the gap;

(d) operating the discharge between adjacent said plates through said apertures to conduct current in the apparatus, thereby forming a sheet of current;

(e) supporting the plates within a housing;

(f) containing gas within the housing; and (g) allowing light to exit the housing.

36. The method of claim 35 wherein said plates are substantially flat.

37. The method of claim 36 wherein each of said linear apertures is straight along its length.

38. The method of claim 37 further comprising the steps of aligning said apertures to create a flat current sheet.

39. The method of claim 37 further comprising the steps of partially aligning the apertures to create a twisted current sheet.

40. The method of claim 36 wherein each of said linear apertures is curved along its length.

41. The method of claim 40 further comprising the steps of substantially aligning said apertures to create a curved current sheet.

42. The method of claim 40 further comprising the steps of partially aligning the apertures to create a twisted current sheet.

43. The method of claim 35 further comprising the steps of curving the plates.

44. The method of claim 43 wherein said anode and cathode plates comprise cylinders concentrically disposed co-axially, and further comprising the steps of aligning the apertures in a plane substantially normal to the co-axis of said cylinders.

45. The method of claim 44 further comprising the steps of convoluting the plates to shield said insulator from direct line-of-sight exposure to said glow discharge, thereby reducing deposition of light and metal vapor upon said insulator.

46. The method of claim 44 wherein the step of initiating comprises the steps of exceeding the breakdown electric field in said gap.

47. The method of claim 44 wherein the step of initiating comprises the steps of triggering the switch at a voltage below the self break threshold.

48. The method of claim 47 wherein the step of triggering comprises the steps of utilizing a secondary discharge.

49. The apparatus of claim 47 wherein the step of triggering comprises the steps of delivering a pulse of electromagnetic radiation.

50. The method of claim 49 wherein the step of triggering comprises the steps of delivering a pulse of light.

51. The method of claim 49 wherein the step of triggering comprises the steps of delivering a pulse of x-ray radiation.

* * * * *